US008887738B2

(12) United States Patent
Ward

(10) Patent No.: US 8,887,738 B2
(45) Date of Patent: Nov. 18, 2014

(54) SUCTION POWERED HAIR-STYLING DEVICE

(71) Applicant: Tina Ward, Oklahoma City, OK (US)

(72) Inventor: Tina Ward, Oklahoma City, OK (US)

( * ) Notice: Subject to any disclaimer, the term of this patent is extended or adjusted under 35 U.S.C. 154(b) by 0 days.

(21) Appl. No.: 14/106,162

(22) Filed: Dec. 13, 2013

(65) Prior Publication Data

US 2014/0261525 A1 Sep. 18, 2014

Related U.S. Application Data

(60) Provisional application No. 61/802,920, filed on Mar. 18, 2013.

(51) Int. Cl.
*A45D 7/02* (2006.01)
*A45D 44/00* (2006.01)

(52) U.S. Cl.
CPC ..... *A45D 44/00* (2013.01)
USPC ..... 132/212

(58) Field of Classification Search
USPC ..... 132/212; 15/246.2, 246, 300.1, 344
See application file for complete search history.

(56) References Cited

U.S. PATENT DOCUMENTS

| | | | | |
|---|---|---|---|---|
| 2,953,808 | A * | 9/1960 | Carmack | 15/365 |
| 3,015,336 | A * | 1/1962 | Caples | 132/213 |
| 3,185,666 | A * | 5/1965 | Harding et al. | 525/480 |
| 4,000,562 | A * | 1/1977 | Alevras | 30/133 |
| 4,409,998 | A | 10/1983 | Bauer | |
| 5,010,905 | A * | 4/1991 | Snyder et al. | 132/272 |
| 5,269,073 | A | 12/1993 | Johnson | |
| 5,924,215 | A | 7/1999 | Goodsell | |
| 6,925,728 | B2 | 8/2005 | Busa | |
| 8,028,437 | B2 * | 10/2011 | Brown-Carter | 34/96 |
| 2002/0184785 | A1 | 12/2002 | Miller | |

* cited by examiner

*Primary Examiner* — Rachel Steitz
(74) *Attorney, Agent, or Firm* — Daniel Boudwin; Global Intellectual Property Agency LLC

(57) ABSTRACT

A portable hair-styling device is provided for creating attractive ponytails. The device has a primary housing containing a motor, an impeller, a blocking flap, and a filter screen. Connecting to the primary housing is a flexible hose, a plurality of styling tubes, and one or more elastic bands. When powered on, a partial vacuum is generated within the flexible hose and the styling tube attached thereto. The free end of the styling tube is moved around the base of the stylee's neck to gather loose hair into the tube, and an elastic band is then positioned on the captured length of hair. The device operator releases the captured hair by depressing a release button on the housing, which engages the blocking flap and temporarily disrupts the flow of air from the flexible hose. After hair is removed from the styling tube it remains styled in a neat ponytail.

11 Claims, 4 Drawing Sheets

SUCTION POWERED HAIR-STYLING DEVICE

CROSS REFERENCE TO RELATED APPLICATION

This application claims the benefit of U.S. Provisional Application No. 61/802,920 filed on Mar. 18, 2013. The above identified patent application is herein incorporated by reference in its entirety to provide continuity of disclosure.

BACKGROUND OF THE INVENTION

1. Field of the Invention

The present invention relates to a hair-styling device. More specifically, it relates to a suction based hair-styling apparatus. The device applies gentle suction to the loose ends of a user's hair, consolidating them within a rigid tube where they can be bound together with an elastic band. The device will be appreciated by disabled persons and persons incapable of manually binding their hair.

The "ponytail" is a commonly used hairstyle involving the gathering of the loose ends of the hair into a single combined length, which is then bound together. This style provides both utility and a well-kept look. For utilitarian purposes, the ponytail is useful in that it restricts the movement of loose hair and prevents it from falling into the facial area of a user. Thus, full visual range is maintained while the ponytail is in place. The lack of free hair strands presents a well-kept or "put together" look and enables the wearer to avoid the appearance of being disheveled.

A variety of binding means are used to restrict the movement of hair placed in a ponytail. In the past, lengths of twine, small rope, and ribbons, were used to tie back the wearer's hair. These methods are still used for stylistic purposes, but are not generally considered to be the most useful method available, because the knotted length may loosen, permitting hair to slip free from the ponytail. Modern ponytail wearers prefer loops of elastic that can be twisted around loose hair until it is constrained.

Despite recent improvements to hair ties, the process of gathering and binding the hair into a ponytail is still time consuming and requires extensive coordination. The user must have full range of motion in both arms and be able to lift and hold both arms near the back of the head for period of time. These movements may prove difficult for persons who are paralyzed, disabled, or elderly. A variety of devices have been introduced into the art to simplify the process of gathering the hair together in a neat length. Unfortunately these devices still require the user to place both arms above the head while they hold the device and their hair. This does not address the problem of assisting persons with limited mobility in the task of creating a ponytail.

A device is needed that enables persons with limited range of motion in the arms, hands or fingers to create a ponytail. The present invention provides an easy to use means of gathering loose hair into a single length, and securing same with an elastic band. The invention does not require the use of brushes, holding the hair while twisting on an elastic band, or other complicated procedures.

2. Description of the Prior Art

Devices have been disclosed in the prior art that relate to hair styling via suction generating machines. These include devices that have been patented and published in patent application publications. These devices generally relate to hair-styling devices. The following is a list of devices deemed most relevant to the present disclosure, which are herein described for the purposes of highlighting and differentiating the unique aspects of the present invention, and further highlighting the drawbacks existing in the prior art.

Hair styling devices that employ a vacuum to apply suction to the hair have been described in the art. These devices are primarily used for drying and straightening hair. By way of example, Busa, U.S. Pat. No. 6,925,728 teach a vacuum attached to a hose and a handheld styling unit. The styling unit is a tube into which hair is inserted. Heating coils are distributed throughout the handheld unit, such that they warm air suctioned into the vacuum. In use, wet hair is placed within the handheld unit and the device is turned on, thereby enabling the flow of warm air across the trapped hair. Bauer, U.S. Pat. No. 4,409,998 discloses a hair-styling device similar to the Busa device but further includes slits along the styling tube and a winding mechanism. Airflow is directed into the slits and through a hose, at the same time the wining mechanism twists the styling tube. Hair is wound around the tube and held in place by the air pressure exerted through the slits. Heating elements within the tube gently heat the hair and facilitate curling of the drying hair.

Similarly, Miller, U.S. Patent Application Publication No. 2002/0184785 teaches a hair conditioning unit having a bi-directional vacuum pump integrated into the device and in connection with the hair-processing unit via a trunk. Several removable hair-processing units are provided for removable connection with the trunk. The direction of airflow through the trunk is controlled by the user and facilitated by an impeller. With this device, hair can be dried using suction or traditional blow-drying methods.

Another vacuum based hair dryer is described in Goodsell, U.S. Pat. No. 5,924,215. The device has a vacuum base unit with an attached suction hose, and a hand held blow dryer unit. The handheld unit is similar in design and function to handheld hair dryers. A trap is integrated into the device to contain loose debris and prevent same from traveling into the motor area. The device can be used as a hair dryer or vacuum.

Other vacuuming devices are used to collect and trap cut or broken hair. Johnson, U.S. Pat. No. 5,269,073 discloses a vacuum base unit attached to a rigid or semi rigid tube. An impeller within the vacuum draws air in through the tube and traps debris within an associated trap. In use, the free end of the hose is held in proximity to a hair styling device, or recently cut hair, where the device can suck up any cut or broken hair.

These prior art devices have several known drawbacks. Though they disclose hair-styling devices employing suction to gather or style hair. None of these include elastic binding bands or a plurality of nesting styling tubes. The prior art devices all require the use of two hands in order to properly operate the device, whereas the present invention is operable using only one hand. It substantially diverges in design elements from the prior art and consequently it is clear that there is a need in the art for an improvement to existing hair-styling devices. In this regard the instant invention substantially fulfills these needs.

SUMMARY OF THE INVENTION

In view of the foregoing disadvantages inherent in the known types of hair-styling devices now present in the prior art, the present invention provides a new suction based hair consolidation means wherein the same can be utilized for providing convenience for the user when forming a tidy ponytail The invention is a hair-styling device that employs mechanically created suction to gather the user's hair into a consolidated length for binding. The device has a portable housing connected to a suction hose, a plurality of interchangeable tubes, and one or more elastic binding bands. The tubes have different diameters in order to accommodate user hair types of varying thickness. Tubes are removably secured to the end of the suction hose prior to use. When the device is powered on, the hair is sucked into the tube. The free end of the tube is moved around the base of the user's head until all loose hair is trapped within the tube by the vacuum. A fine grate filter screen is disposed between the suction tube and the housing, which prevents hair and debris from being sucked into the housing while in use. The hair of the user is free to enter the tube length but is blocked from entering into the housing itself and entangling with the mechanical elements therein.

Prior to use, an elastic hair-binding band is secured on the free end of the tube. This may be accomplished by twisting the hair band into smaller loops until it fits snuggly around the exterior of the tube. Once hair is neatly gathered the hair is bound into a ponytail. The user rolls the elastic hair-binding band off the end of the tube and onto the collected hair. The band may be rolled upward until it sits against the back of the head. A user's hair is removed from the tube after the device is turned off, leaving the hair trapped within the hair-binding band in a neat ponytail. This process requires a minimum amount of coordination and no fine motor skills. It is therefore optimal for persons with limited range of motion in the upper limbs, or poor motor function.

It is therefore an object of the present invention to provide a new and improved hair-styling device that has all of the advantages of the prior art and none of the disadvantages.

It is another object of the present invention to provide a hair-styling device that can be easily transported wherever a user travels.

Another object of the present invention is to provide a hair-styling device that can be utilized by persons having limited range of motion or reduced motor function in their hands, arms, or fingers.

Yet another object of the present invention is to provide a hair-styling device that neatly constrains loose hair together while a user binds the hair into a ponytail.

Still another object of the present invention is to provide hair-styling devices that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
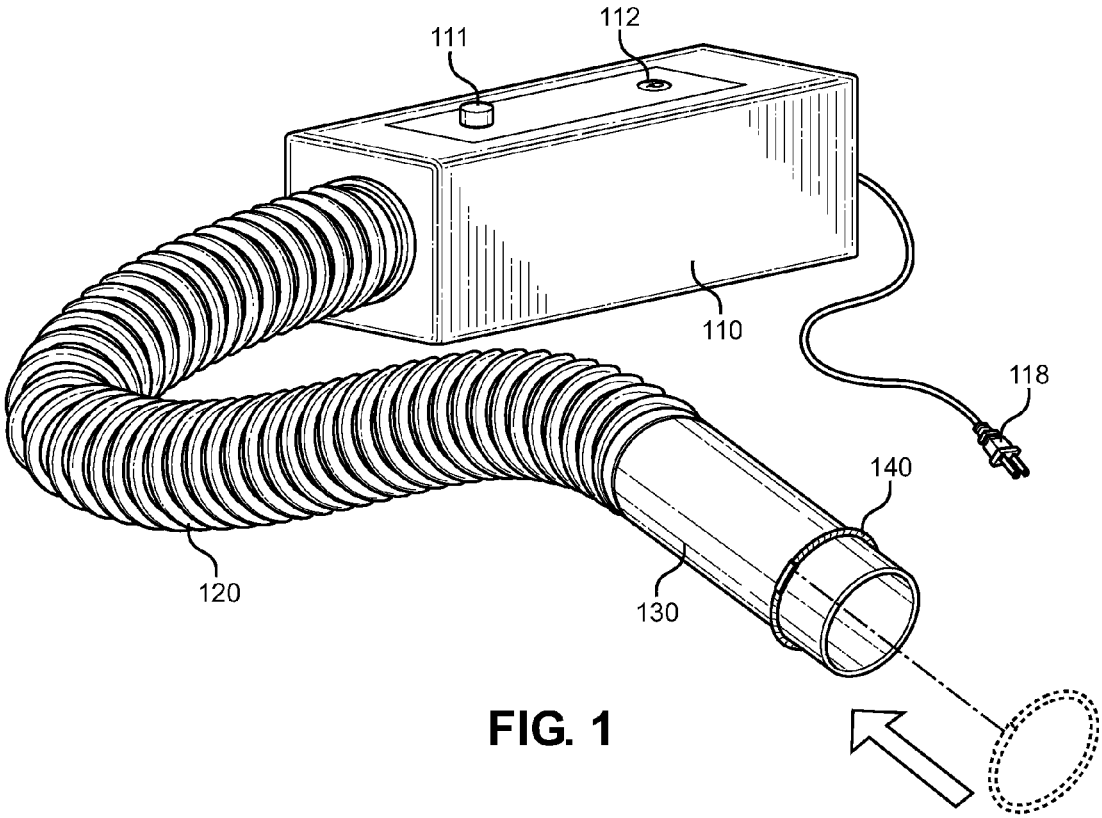
FIG. 1 shows a perspective view of the present hair-styling device with the suction hose and styling tube attached. An elastic binding band is being affixed to the free end of the styling tube.

Reference is made herein to the attached drawings. Like reference numerals are used throughout the drawings to depict like or similar elements of the hair-styling device. For the purposes of presenting a brief and clear description of the present invention, the preferred embodiment will be discussed as used for styling the hair in a ponytail. The figures are intended for representative purposes only and should not be considered to be limiting in any respect.

Figure 2:
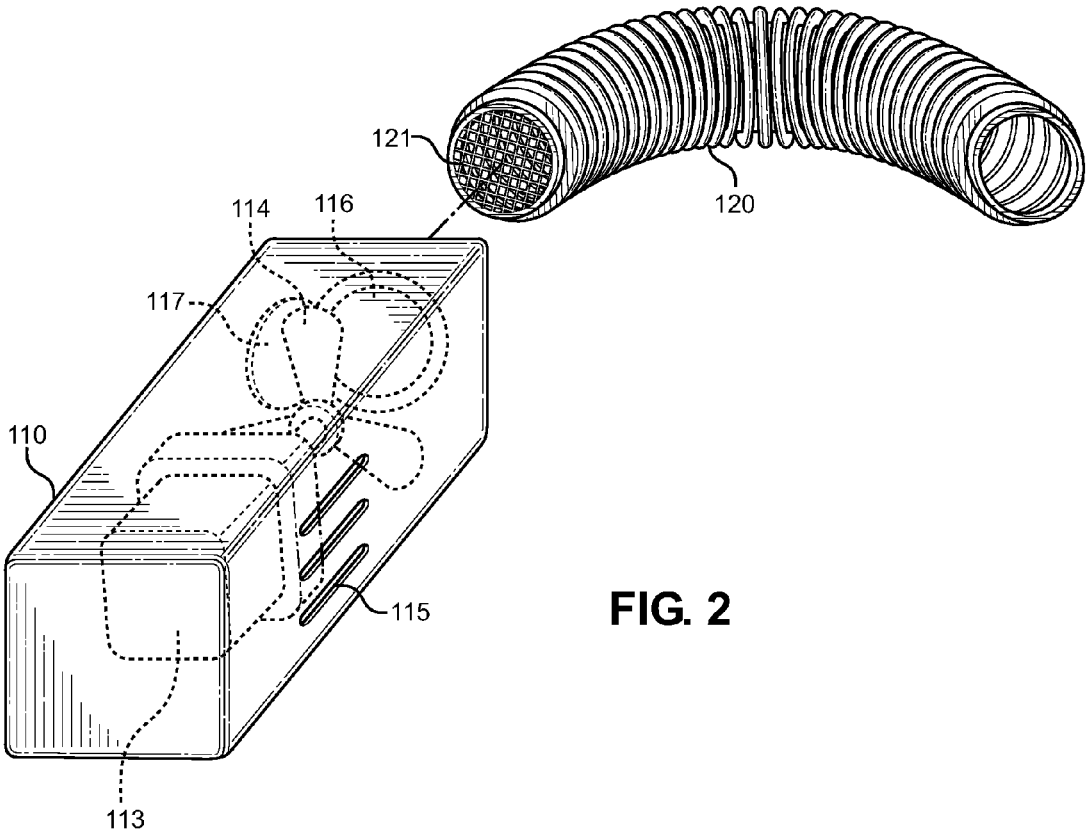
FIG. 2 shows a perspective view of the hair-styling device without the styling tube attached.

Illustrated in FIGS. 1 & 2 is a view of an exemplary design of the present invention. The invention is a portable hair-styling unit that generates a partial vacuum along a tunnel. This partial vacuum facilitates capture and retention of a user's hair during the application of elastic binding band or other hair constraining device. Upon successful deployment of the elastic binding band, the user may turn the device off or press a release button to cease suction and enable removal of hair from the device. The user's hair is left in a ponytail restrained with the binding means.

The device has a primary housing 110, a flexible hose 120, a plurality of styling tubes 130, and one or more elastic binding bands 140. The primary housing may have any desired shape but should maintain an easily portable size. Contained within the interior of the housing is a motor 113 in operative connection with an impeller 114, and an electrical connection 118 to an exterior or interior power source. The housing itself has both an exhaust port 115 and intake port 116. Exhaust ports may be in the form of a plurality of venting slits, a single opening covering by a grating, or any other exhausting mechanism known in the art of small vacuums. The intake port is an opening along the wall of the housing, where the suction hose connects to the housing. Examples of hose connection mechanisms include screw threading; snap together tabs, and depressible tabs. The construction of easily portable vacuums is known in the art and minor modification will be apparent to one of ordinary skill.

Along the housing exterior a power button 111 and release button 112 are disposed. The power button is electrically connected to the motor such that interaction with the button initiates and terminates the flow of electricity to the motor. Electric flow powers the motor, which in turn turns the impeller rotatably mounted thereto. As the impeller rotates, it creates an air pressure differential leading to a partial vacuum on one side of the impeller. To ensure that suction is created within the flexible hose, the impeller is positioned within the hollow interior of the housing in a space at or next to the intake port. Thus, when the impeller begins to rotate air is pushed from the free end of the hose through same and to the impeller, where it is then dispersed towards the exhaust port (s). In some embodiments, impeller speed is adjustable, to enable a user to adjust the level of suction. This feature may be useful for gathering thicker or denser hair that is too heavy to be picked up with low suction levels. Impeller speed functionality may be implemented by using a sliding power switch that toggles motor settings, or a depressible button set on a motor mode switching circuit. Alternatively, the mode-switching button may be separate from the power button and disposed elsewhere on the housing exterior (not shown).

A release button enables user to quickly remove their hair from the device. When depressed, the button initiates movement of a blocking flap 117 operatively connected to the motor. In a preferred embodiment shown in FIG. 2, the flap is positioned near the intake port such that it covers the intake port when deployed by the motor. When inactive, the blocking flap is withdrawn into a stowed state. Alternatively, the blocking flap may be a plurality of concentrically arranged, overlapping flaps that extend inward when deployed to cover the intake port. In either embodiment, deployment of the flap temporarily cuts off the pneumatic connection between the hose and the impeller, thereby terminating suction. Without a maintained partial vacuum, the user can easily remove their hair from the styling tube.

To prevent loose hair and other debris from entering the hose, a fine filter 121 such as a mesh grating or porous material (such as the cloth used in vacuum bags) is disposed across the opening of the hose end that attaches to the housing. This end removably secures to the intake port of the housing. The presence of the filter reduces the amount of debris that enters the housing through the hose. Debris in the housing can become entangled in the impeller and reduce effectiveness of the device's operations. The filter can be cleaned of collected debris by removing the attached styling tube and dumping the debris collected in the hose into a waste receptacle.

Figure 3A:
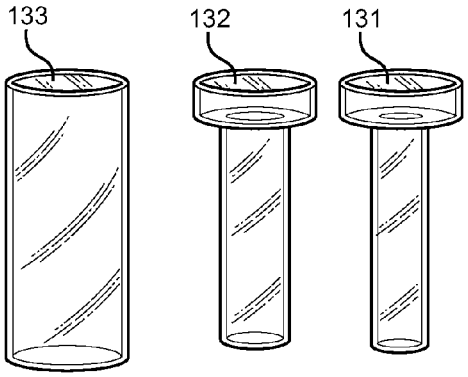
FIG. 3A show a side view of a set of styling tubes of varying diameter.

Turning now to FIG. 3A there is shown a side view of an exemplary set of styling tubes 131-133. The tubes have varying diameters in order to accommodate different hair thickness. Different styling tubes may be used with the same user in order to create ponytails of different size. By way of example, a styling tube of large diameter (relative to the other tubes) will not compact hair as tightly within the tube and the resulting ponytail will be fuller. The tubes are rigid, hollow, cylinders with a connection means disposed at one end to facilitate removable securement with the flexible hose. Connection means may entail screw threading, snaps, depressible snaps, or the like. Tube ends opposing the connection means should be smooth along the exterior and free from any impediment, which might prevent an elastic binding band from sliding down the tube. During use, one or more elastic binding bands are placed around the free end of the styling tube. The band is later slid off the tube and onto the user's hair to create the finished ponytail.

Figure 3B:
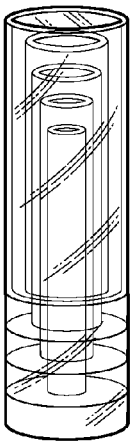
FIG. 3B shows a side view of the styling tubes stacked in a nested configuration for storage.

The styling tubes are nested within one another while in a stowed state. This compacted stowed state is shown in FIG. 3B and the shape of the styling tubes is shown in FIG. 3A. The styling tubes 130 have different diameters, but approximately the same length. Tubes of smaller diameter have broad protruding ledges along the connection end of the tube. The depth of ledge protrusion increases as tube diameter decreases. Thus, the smallest tube has the broadest ledge at its connection end. These ledges serve as a base for other tubes to rest upon. The tubes are placed over one another, onto the base, in order of smallest diameter to largest diameter, such that the tube of largest diameter is the last. Alternatively, only the smallest styling tube may have a base, and the other tubes may all be hollow cylinders, each tube having uniform exterior diameter.

Figure 4A:
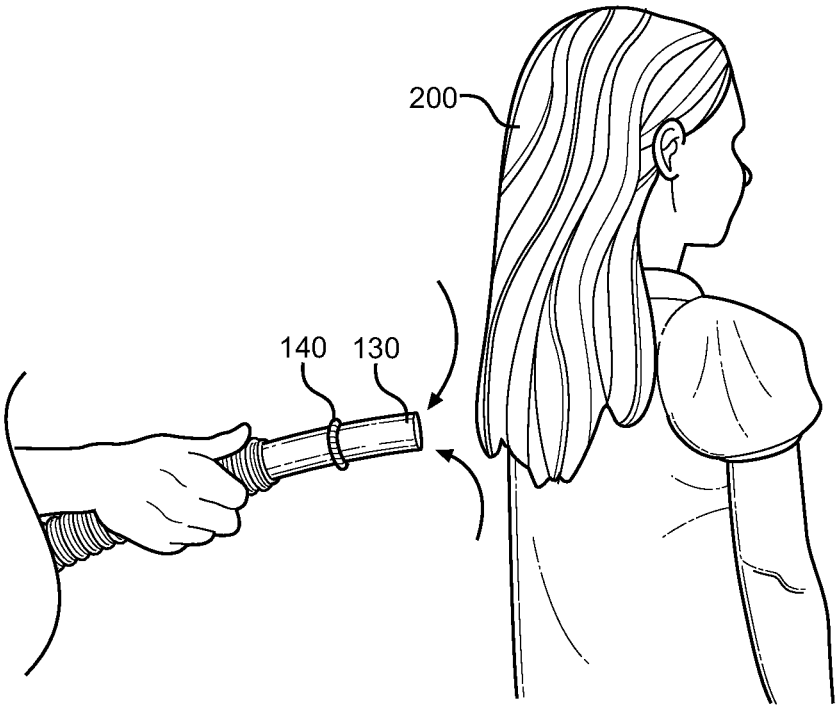
FIG. 4A shows a perspective view of the hair-styling device in use. The styling tube is moved around the base of the user's neck to gather loose ends of the user's hair prior to styling.
Figure 4B:
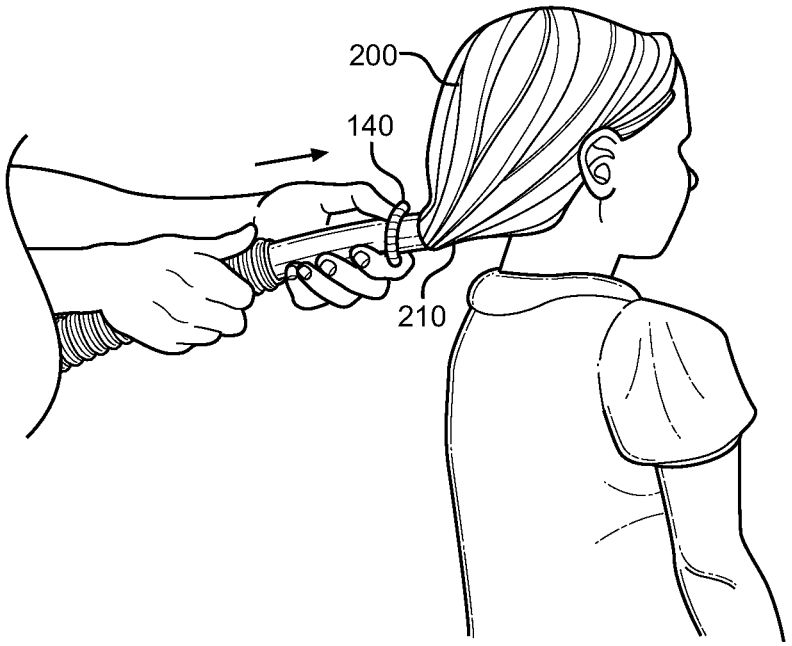
FIG. 4B shows a perspective view of the hair-styling device in use. After hair is gathered into the styling tube, an elastic binding band is slid off the tube and onto the collected length of hair.
Figure 4C:
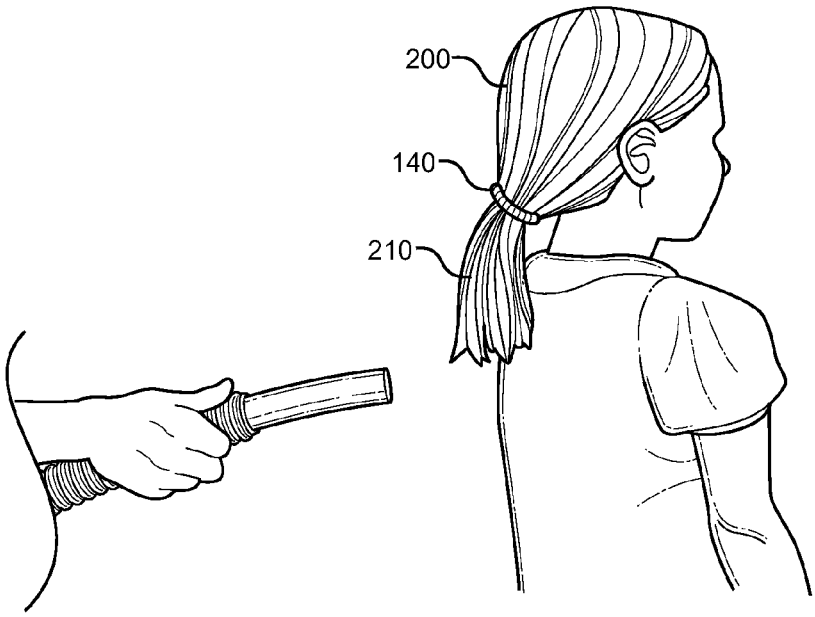
FIG. 4C shows a perspective view of the hair-styling device in use. The device is removed once the elastic binging band is in place, and the hair is left in a neat ponytail.

In FIGS. 4A-4C the hair-styling device is shown during normal use. The user's hair 200 is sucked into the styling tube by maneuvering the free end of the tube around loose ends of hair. Hair sucked into the tube is compacted into a single length 210 of hair. Once all hair is gathered, an elastic binding band 140 is slid off the end of the styling tube and onto the length of hair. The release button on the machine is then pressed to temporarily disrupt suction while hair is removed from the styling tube. Alternatively, the power button may be engaged, to turn the device off. The style is left with a neat ponytail, without the hassle of brushing, combining and detangling the hair. The styling tube does not need to be held in place while the binding band is positioned on the length of hair, thus the device can be used single-handed. In this way, the device is ideal for persons with limited range of motion.

The invention is a simple to use hair-styling tool for creating attractive and neat ponytails. Gentle suction is employed to collect hair and constrain it to a single length while a binding means is applied. The device is useful to those with limited mobility as well as those who are not familiar with traditional ponytail making technique. To increase convenience, the device is highly portable and includes styling tubes that are easily storable in a nested configuration.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hair-styling device for creating ponytails, comprising:

a primary housing having a hollow interior, wherein said housing has an intake port and an exhaust port;

a motor electrically connected to a power source;

an impeller, electrically connected to said motor, wherein said impeller is positioned within said hollow interior near said intake port;

a power button disposed on an exterior of said primary housing, wherein said button controls flow of electricity to said motor;

a release button disposed on said exterior of said primary housing;

a flexible hose having a first end and a second end, said first end being removably attached to said primary housing at said intake port, wherein said flexible hose is connected to said primary housing via an airtight seal;

a filter screen at said first end of said flexible hose;

a plurality of hollow styling tubes, wherein each of said styling tubes is adapted to removably secure to said second end of said flexible hose, and wherein each of said styling tubes has a diameter substantially different than the other styling tubes;

one or more elastic binding bands designed to fit around an exterior portion of said styling tubes.

2. The hair-styling device of claim 1, wherein the rotational speed of said impeller is alterable.

3. The hair-styling device of claim 2, wherein the rotational speed of said impeller is altered via said power button, wherein said power button is connected to an electrical cycle controlling power flow and impeller speed.

4. The hair-styling device of claim 2, wherein the rotational speed of said impeller is altered via an independent switch disposed on said exterior of said primary housing.

5. The hair-styling device of claim 1, wherein said exhaust port is a plurality of slits extending through said primary housing exterior and providing pneumatic flow between said hollow interior and an outside environment.

6. The hair-styling device of claim 1, further comprising:

a blocking flap operatively connected to said motor such that depression of said release button results in deployment of said blocking flap, and wherein said blocking flap is positioned within said hollow interior at said intake port.

7. The hair-styling device of claim 1, wherein said filter screen is a mesh grating.

8. The hair-styling device of claim 1, wherein said plurality of tubes are nesting such that the styling tube of largest diameter houses all of the styling tubes of smaller diameter when in a stowed configuration.

9. The hair-styling device of claim 1, wherein the styling tube of smallest diameter has an outwardly protruding ledge upon which the remainder of said plurality of styling tubes rest, in a concentrically nested configuration, when in a stowed state.

10. The hair-styling device of claim 9, wherein the diameter of said outwardly protruding ledge of smallest tube is the same as that of the styling tube with the largest diameter.

11. The hair-styling device of claim 1, wherein a portion of said styling tubes of smaller diameter have an outwardly protruding ledge upon which styling tubes of larger diameter rest, in a concentrically nested configuration, when in a stowed state.

* * * * *